US005598382A

United States Patent [19]

Wilson et al.

[11] Patent Number: 5,598,382

[45] Date of Patent: Jan. 28, 1997

[54] DUAL PLANE EL PANEL

[75] Inventors: Wayne A. Wilson, Gilbert; James H. Butt, Mesa, both of Ariz.

[73] Assignee: Durel Corporation, Chandler, Ariz.

[21] Appl. No.: 555,213

[22] Filed: Nov. 8, 1995

[51] Int. Cl.[6] ..... G04B 19/32

[52] U.S. Cl. ..... 368/226; 368/67; 368/227

[58] Field of Search ..... 368/226, 67, 227

[56] References Cited

U.S. PATENT DOCUMENTS

| | | | |
|---|---|---|---|
| 4,458,177 | 7/1984 | Hunter et al. | 313/511 |
| 4,683,360 | 7/1987 | Maser | 200/314 |
| 4,730,146 | 3/1988 | Maser et al. | 313/511 |
| 4,733,488 | 3/1988 | Yokoyama et al. | 40/544 |
| 4,947,291 | 8/1990 | McDermott | 362/19 |
| 5,045,755 | 9/1991 | Appelberg | 313/498 |
| 5,266,865 | 11/1993 | Haizumi et al. | 313/506 |
| 5,466,990 | 11/1995 | Winsor | 313/56 |

*Primary Examiner*—Bernard Roskoski
*Attorney, Agent, or Firm*—Cahill, Sutton & Thomas P.L.C.

[57] ABSTRACT

An EL panel includes a pair of EL lamps on a common substrate, separated by a predetermined distance along a longitudinal axis. A first flexible, electrically conductive trace on the substrate interconnects the front electrodes of the lamps and a second flexible, electrically conductive trace on the substrate interconnects the rear electrodes of the lamps. The lamps share a common front electrode and the first trace overlies the front electrode between the lamps. One of the lamps is rotated relative to the other to position the lamps one above the other in separate, parallel planes.

12 Claims, 1 Drawing Sheet

DUAL PLANE EL PANEL

BACKGROUND OF THE INVENTION

This invention relates to electroluminescent (EL) lamps and, in particular, to an EL lamp providing illumination in two, parallel planes.

An EL lamp is essentially a capacitor having a dielectric layer between two conductive electrodes, one of which is transparent. The dielectric layer, or a separate layer, includes a phosphor powder which radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer substrate, such as polyester or polycarbonate, that provides mechanical integrity and support for the other layers.

Because of the uniformity of the light and the variety of colors of EL lamps, the number of applications for EL lamps grows steadily. EL lamps are planar or sheet devices and there are some applications in which a display is made in two or more stacked planes, as in watches having both an analog display and a digital display. The analog display is a dial and the digital display is a liquid crystal display (LCD) located within the dial. A single EL lamp cannot be used to backlight both displays because an LCD is much thicker than a dial face. Space in a watch is conserved by cutting a hole or window in the dial and positioning the LCD in the window. Even so, the thickness of an LCD precludes the use of a single EL lamp for backlighting both displays. Thus, two lamps and four electrical connections must be included in each analog/digital watch. Each connection adds cost and adds a small but finite chance for failure.

As used herein, an EL "panel" is a single substrate including one or more luminous areas, wherein each luminous area is an EL "lamp."

In view of the foregoing, it is therefore an object of the invention to provide a single EL panel having at least two lamps that can be stacked to provide lamps in at least two planes.

A further object of the invention is to provide a single EL panel having lamps in at least two parallel planes mechanically joined by a common substrate.

Another object of the invention is to provide a single EL panel having at least two lamps in different planes emitting light in substantially the same direction.

A further object of the invention is to provide a single EL panel having lamps in at least two parallel planes electrically interconnected by a single pair of conductors.

SUMMARY OF THE INVENTION

The foregoing objects are achieved in this invention in which an EL panel includes a pair of EL lamps on a common substrate, separated by a predetermined distance along a longitudinal axis. A first flexible, electrically conductive trace on the substrate interconnects the front electrodes of the lamps and a second flexible, electrically conductive trace on the substrate interconnects the rear electrodes of the lamps. In a preferred embodiment of the invention, the lamps share a common front electrode and the first trace overlies the front electrode between the lamps. One of the lamps is rotated relative to the other to position the lamps one above the other in separate, parallel planes.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
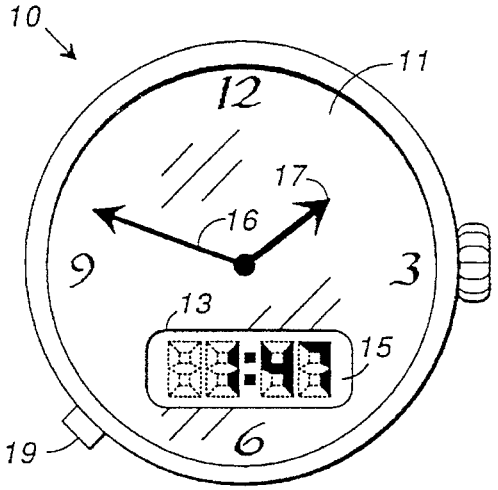
FIG. 1 is a plan view of a watch including an analog display and a digital display.

FIG. 1 illustrates a watch having an analog display and a digital display. Watch 10 includes dial 11 and hands 16 and 17 for indicating time of day. Dial 11 can be a transparent plastic sheet with numbers printed on it or numbers representing time of day are printed directly on the front (the transparent substrate) of an EL lamp. Dial 11 has hole 13 in the lower half thereof to provide a window for digital display 15, illustrated as a four digit, liquid crystal display. Button 19 is depressed to turn on a light for illuminating dial 11 and display 15.

Even if the front of display 15 were coplanar with dial 11, an EL lamp backlighting display 15 would be separated from the face of the watch. The enclosed space between the dial and the lamp must be unobstructed to backlight the dial, greatly increasing the thickness of the watch. Thus, a single EL lamp cannot be used for backlighting dial 11 and display 15. In the prior art, two lamps and four connections were required for backlighting two displays.

Figure 2:
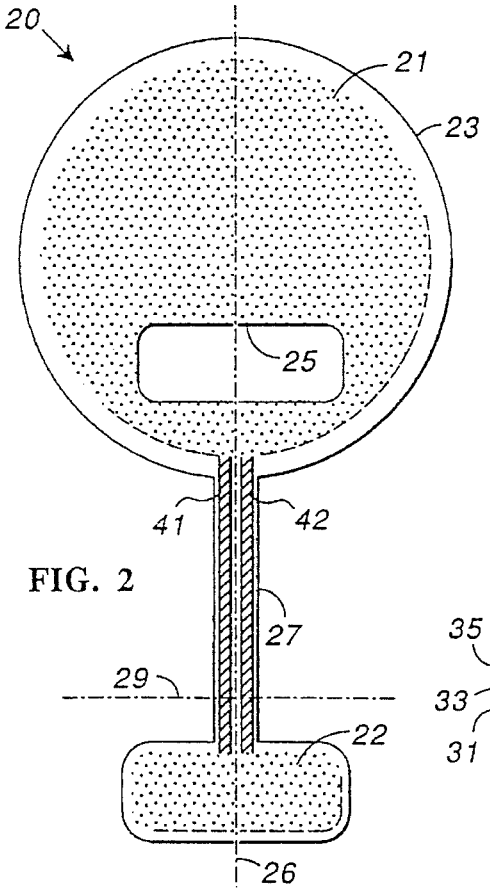
FIG. 2 is a plan view of an EL panel constructed in accordance with a preferred embodiment of the invention.

FIG. 2 illustrates an EL lamp constructed in accordance with the invention for providing backlighting on two parallel planes. In FIG. 2, the luminous areas of panel 20 are indicated by stippling. Panel 20 includes first lamp 21 and second lamp 22 on common substrate 23. Hole 25 in substrate 23 and in lamp 21 provides clearance for a liquid crystal display. A suitable analog dial (not shown) can be printed on the outer surface of substrate 23 (the side facing into the plane of the drawing).

Lamp 21 and lamp 22 are physically separated along longitudinal axis 26 and are mechanically connected by common substrate 23. In a preferred embodiment of the invention, the width of substrate 23 between the lamps is less than the width of either lamp, forming isthmus 27. Substrate 23 is preferably a sheet of polyester or polycarbonate and the lamps formed thereon are coplanar. Isthmus 27 permits lamp 22 to be reoriented relative to lamp 21 to provide stacked lamps in separate planes.

Figure 3:
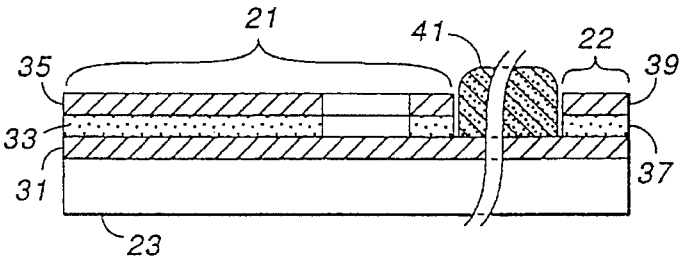
FIG. 3 is a cross-section of an EL panel constructed in accordance with a preferred embodiment of the invention.

FIG. 3 is a cross-section of panel 20. Lamp 21 includes substrate 23, transparent front electrode 31, electroluminescent layer 33 and rear electrode 35. Lamp 22 includes substrate 23, transparent front electrode 31, electroluminescent layer 37, and rear electrode 39. Transparent front electrode 31 is preferably a thin layer of indium oxide or indium tin oxide. Such a layer is relatively frail and vigorous flexing of substrate 23 would likely result in a plurality of fractures in electrode 31. Conductive trace 41 is deposited on electrode 31 to strengthen the electrode. In a preferred embodiment of the invention, a conductive ink is screen printed on front electrode 31 to provide a rugged, flexible, conductive trace mechanically and electrically connected to the electrode.

As illustrated in FIG. 2, conductive trace 41 extends the length of isthmus 27, electrically connecting lamp 21 to lamp 22. Conductive trace 42 extends parallel to trace 41 and interconnects the rear electrodes of lamp 21 and lamp 22. Trace 42 is deposited on a substrate 23 in the isthmus. The ends of trace 42 overlap the rear electrodes (not shown) of lamp 21 and lamp 22, electrically connecting the lamps. Contact to panel 20 is made anywhere along the length of conductive traces 41 and 42, e.g. by pins or by an adherent conductor.

Figure 4:
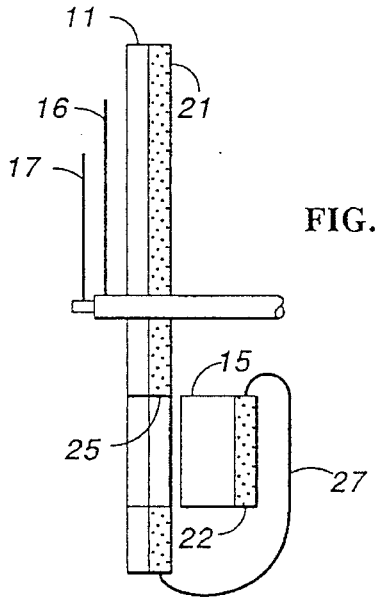
FIG. 4 is a diagram illustrating how an EL panel is rotated about a single axis to provide lamps in two planes emitting light/in substantially the same direction.

FIG. 4 illustrates the orientation of panel 20 for providing two planes of backlighting. Dial 11 is back lit by lamp 21 and liquid crystal display 15 is back lit by lamp 22. Lamp 21 is connected to lamp 22 by isthmus 27. Both lamp 21 and lamp 22 emit light in a direction to the left of the diagram as illustrated in FIG. 4. In order to do this, lamp 22 is rotated 360° about axis 29 (FIG. 2). This rotation brings lamp 22 behind lamp 21 and facing in the same direction as lamp 21. In FIG. 2, the corresponding rotation would be for lamp 22 to be pushed into the plane of the drawing and rotated about axis 29 until lamp 22 is aligned with hole 25.

Rotational axis 29 is perpendicular to longitudinal axis 26 and can be located anywhere along the lower half of isthmus 27, as oriented in FIG. 2, or can be located anywhere along the length of lamp 22. Isthmus 27 is preferably more than twice the length of lamp 22, as measured along axis 26. The preferred length of isthmus 27 assures that lamp 22 can rotate 360°.

Figure 5:
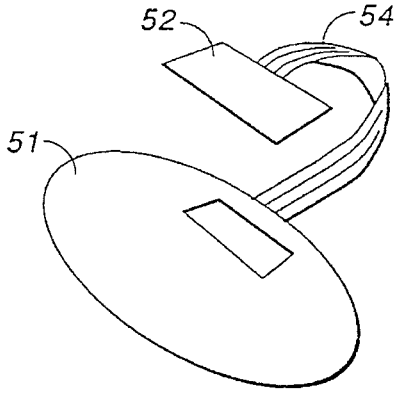
FIG. 5 is a diagram illustrating how an EL panel is rotated about two axes to provide lamps in two planes emitting light in substantially the same direction.

FIG. 5 illustrates an alternative embodiment of the invention wherein lamp 52 is rotated 180° about axis 29 and is rotated 180° about axis 26 to align lamp 52 to face in the same direction as lamp 51. Lamp 51 is connected to lamp 52 by conductive strip 54, all of which are constructed on a common substrate as described above. Strip 54 is shorter than isthmus 27 (FIG. 2) because strip 54 does not have to overlap the lamp, as shown in FIG. 4. Either technique for producing parallel, stacked lamps can be used to suit a particular application.

The invention thus provides a single EL panel having at least two lamps that can be stacked to provide lamps in two planes, wherein the lamps are on a single substrate. Further, power to the lamps is applied through a single pair of connections, rather than through two pairs of connections as in the prior art.

Having thus described the invention, it will be apparent to those of skill in the art that various modifications can be made within the scope of the invention. For example, the number of planes is determined by the particular application. A second isthmus and a third lamp could be connected to the top of panel 20 (FIG. 2). Still more lamps could also be provided. Because the lamps are physically separated, the lamps can be different colors. Each color requires a separate printing step but is easily accomplished. Although described in a preferred embodiment as a lamp panel for watch applications, the invention can be used in any application requiring lamps in different planes, e.g. instrumentation or portable electronic devices such as pagers or transceivers.

What is claimed as the invention is:

1. An electroluminescent panel for providing illumination in two parallel planes, said panel comprising:

a first electroluminescent lamp;

a second electroluminescent lamp on a common substrate with said first electroluminescent lamp;

wherein said first electroluminescent lamp and said second electroluminescent lamp are spaced apart a predetermined distance along a first axis;

wherein the portion of said substrate between said first electroluminescent lamp and said second electroluminescent lamp is narrower than the larger of the electroluminescent lamps, enabling said second electroluminescent lamp robe reoriented relative to said first electroluminescent lamp to provide stacked lamps in separate planes.

2. The electroluminescent panel as set forth in claim 1 wherein said substrate is transparent and said first electroluminescent lamp and said second electroluminescent lamp share a common transparent front electrode deposited on said substrate.

3. The electroluminescent panel as set forth in claim 2 and further including:

a flexible, conductive trace on said portion between said first electroluminescent lamp and said second electroluminescent lamp; wherein said front electrode is electrically connected to said flexible, conductive trace in said portion.

4. The electroluminescent panel as set forth in claim 1 wherein said first electroluminescent lamp is substantially planar;

said second electroluminescent lamp has a length measured along said first axis;

said predetermined distance is greater than twice said length; and said second electroluminescent lamp can be rotated out of the plane of said first electroluminescent lamp to a second plane parallel to the plane of said first electroluminescent lamp.

5. The electroluminescent panel as set forth in claim 4 wherein said second electroluminescent lamp can be rotated 360° about a second axis perpendicular to said first axis.

6. The electroluminescent panel as set forth in claim 1 wherein the portion of said substrate between said first electroluminescent lamp and said second electroluminescent lamp is narrower than either lamp.

7. The electroluminescent panel as set forth in claim 1 wherein said second electroluminescent lamp can be rotated 180° about said first axis and rotated 180°°about a second axis perpendicular to said first axis to position said second electroluminescent lamp in a plane parallel to the plane of said first electroluminescent lamp.

8. In a watch having a first display and a second display, the improvement comprising:

a single EL panel having two EL lamps in separate planes, wherein a first EL lamp backlights said first display: and a second EL lamp backlights said second display.

9. The watch as set forth in claim 8 wherein said first EL lamp and said second EL lamp are spaced apart a predetermined distance along a first axis on a common substrate and said watch further includes:

a flexible, conductive trace between said first EL lamp and said second EL lamp;

wherein said conductive trace overlies a portion of said common substrate and wherein said portion is curved to align said first EL lamp parallel with said second EL lamp.

10. The watch as set forth in claim 9 wherein said portion is curved 360°.

11. The watch as set forth in claim 9 wherein said portion is curved 180° and twisted 180°.

12. The watch as set forth in claim 8 wherein the first EL lamp includes a hole and said portion is curved to align said second EL lamp with said hole and wherein said second EL lamp is visible through said hole.

* * * * *

UNITED STATES PATENT AND TRADEMARK OFFICE

CERTIFICATE OF CORRECTION

PATENT NO. : 5,598,382

DATED : January 28, 1997

INVENTOR(S) : Wilson et al.

It is certified that error appears in the above-indentified patent and that said Letters Patent is hereby corrected as shown below:

Column 4, line 14, should read as follows.

"minescent lamp to be reoriented relative to said first"

Signed and Sealed this

Twenty-fourth Day of June, 1997

Bruce Lehman

*Attest:*

BRUCE LEHMAN

*Attesting Officer*

*Commissioner of Patents and Trademarks*